United States Patent [19]

Petersson

[11] 4,202,150

[45] May 13, 1980

[54] DEVICE FOR PRODUCING ENVELOPES IN A CONTINUOUS OPERATION

[75] Inventor: Nils E. Petersson, Nybro, Sweden

[73] Assignee: AB Sture Ljungdahl, Nybro, Sweden

[21] Appl. No.: 914,950

[22] Filed: Jun. 12, 1978

Related U.S. Application Data

[63] Continuation of Ser. No. 742,840, Nov. 18, 1976, which is a continuation-in-part of Ser. No. 722,489, Sep. 13, 1976, abandoned, which is a continuation of Ser. No. 471,484, May 20, 1974, abandoned.

[30] Foreign Application Priority Data

May 25, 1973 [SE] Sweden ..... 7307391

[51] Int. Cl.[2] ..... B65B 11/48

[52] U.S. Cl. ..... 53/206

[58] Field of Search ..... 53/460, 463, 206, 117, 53/228, 230, 266 A; 93/617, 62, 63 R; 156/489, 499

[56] References Cited

U.S. PATENT DOCUMENTS

| | | | |
|---|---|---|---|
| 911,542 | 2/1908 | Owens | 53/228 |
| 3,242,637 | 3/1966 | Willis | 53/117 X |
| 3,336,726 | 8/1967 | Mayer et al. | 53/117 |
| 3,593,486 | 7/1971 | Helm | 53/460 |
| 3,641,883 | 2/1972 | Smithe et al. | 93/62 |
| 3,643,555 | 2/1972 | Ehlscheid | 93/62 |
| 4,003,183 | 1/1977 | Helm | 53/460 |

*Primary Examiner*—John Sipos

*Attorney, Agent, or Firm*—Hane, Roberts, Spiecens & Cohen

[57] ABSTRACT

There is disclosed a machine for producing an item of mail essentially consisting of an enclosure and an envelope therefor. The enclosures are successively fed to a folding station of the machine by a conveyor. The folded enclosures are conveyed to an insertion station of the machine to be readied for insertion into an envelope and are then conveyed to an enveloping station of the machine. Envelope blanks are successively fed by a second conveyor to the enveloping station and wrapped in that station about enclosures, thereby forming an envelope for the enclosures. The first conveyor then feeds the envelopes with the enclosures therein successively to a sealing station; a franking station and a collecting station.

5 Claims, 7 Drawing Figures

DEVICE FOR PRODUCING ENVELOPES IN A CONTINUOUS OPERATION

This is a continuation of application Ser. No. 742,840 filed Nov. 18, 1976, now pending, which in turn is a continuation-in-part of application Ser. No. 722,489 filed Sept. 13, 1976, now abandoned, and which in turn is a continuing application based on application Ser. No. 471,484 filed May 20, 1974 and now abandoned.

The present invention relates to an apparatus for producing a folded item and more particularly to an apparatus for producing envelopes in continuous operation.

BACKGROUND

During the last few years the production of items to be sent through the mails or otherwise delivered, comprising documents of various kinds, has been subject to a certain development towards increasing automatization. Although this development has involved a reduction of the manual handling and has increased the production rate, there are still problems that remain to be solved. There are particular difficulties involved in preparing items of mail containing forms or documents prepared at high speed in computers, which moreover, often for secrecy reasons, must be sent in envelopes that can be sealed. The machines hitherto available for inserting matter in envelopes are all too slow in relation to the output speed of modern computer printers. This insufficient capacity has the result that those who have computers with high output volumes have to procure a great number of machines for inserting the output in envelopes, which involves a comparatively great investment and requirements for much space, and in addition thereto more extensive maintenance and adjusting work is required.

The purpose of the present invention is to provide a machine for producing items of mail ready to be dispatched in pace with a printer.

Figure 1B:
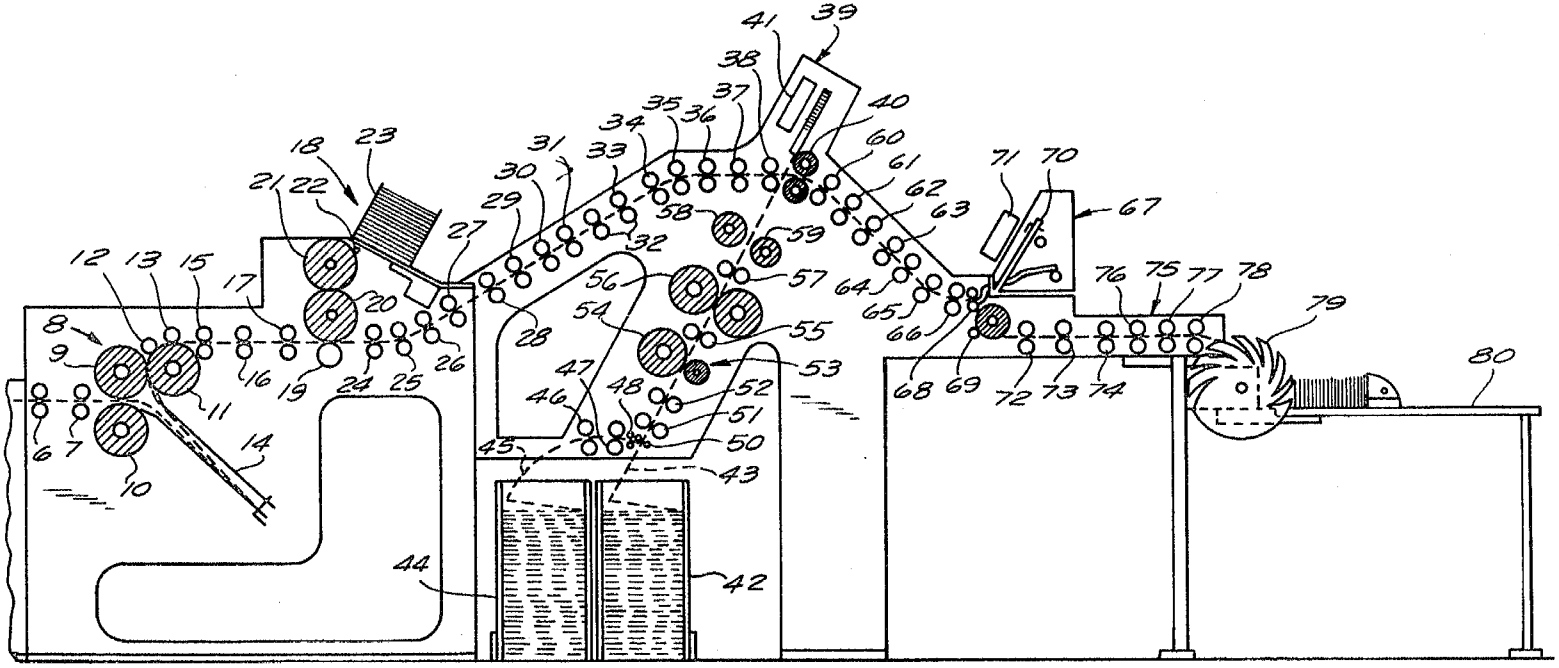
Figure 1A:
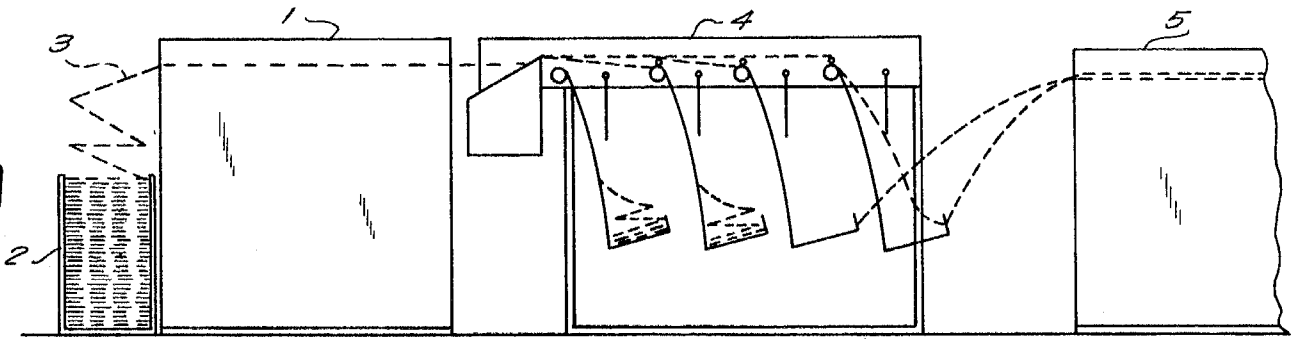

The present invention will be described in more detail in the following with reference to the attached drawings, in which FIG. 1A shows a schematic side view of a machine or assemblage for carrying out the method according to the invention.

Figure 4:
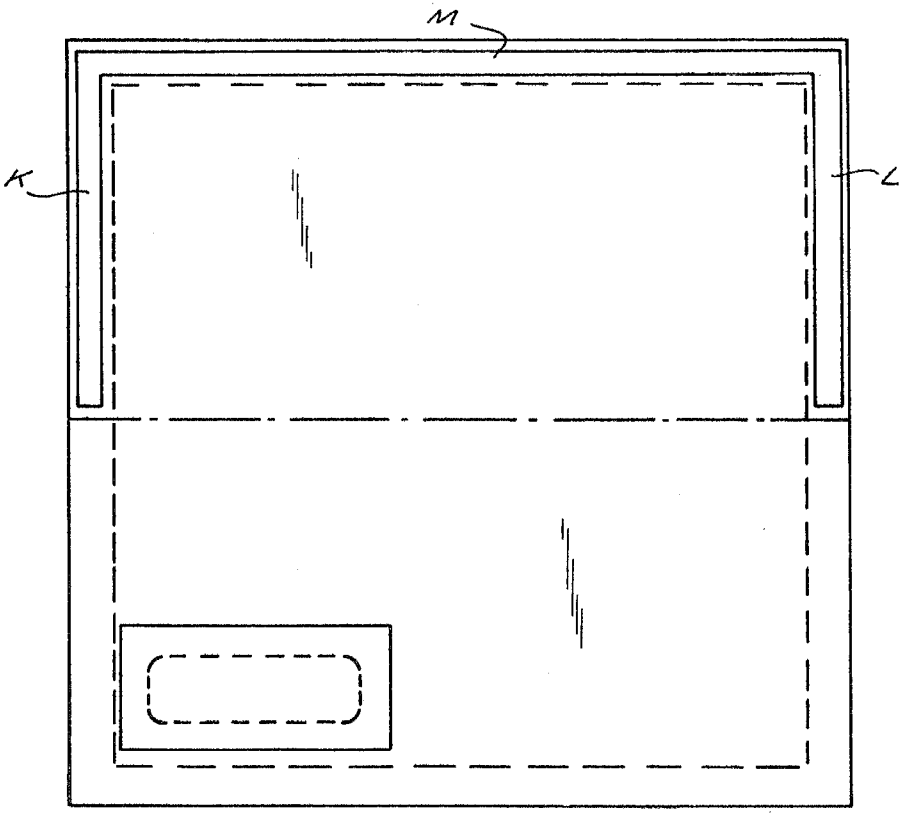
Figure 2A:
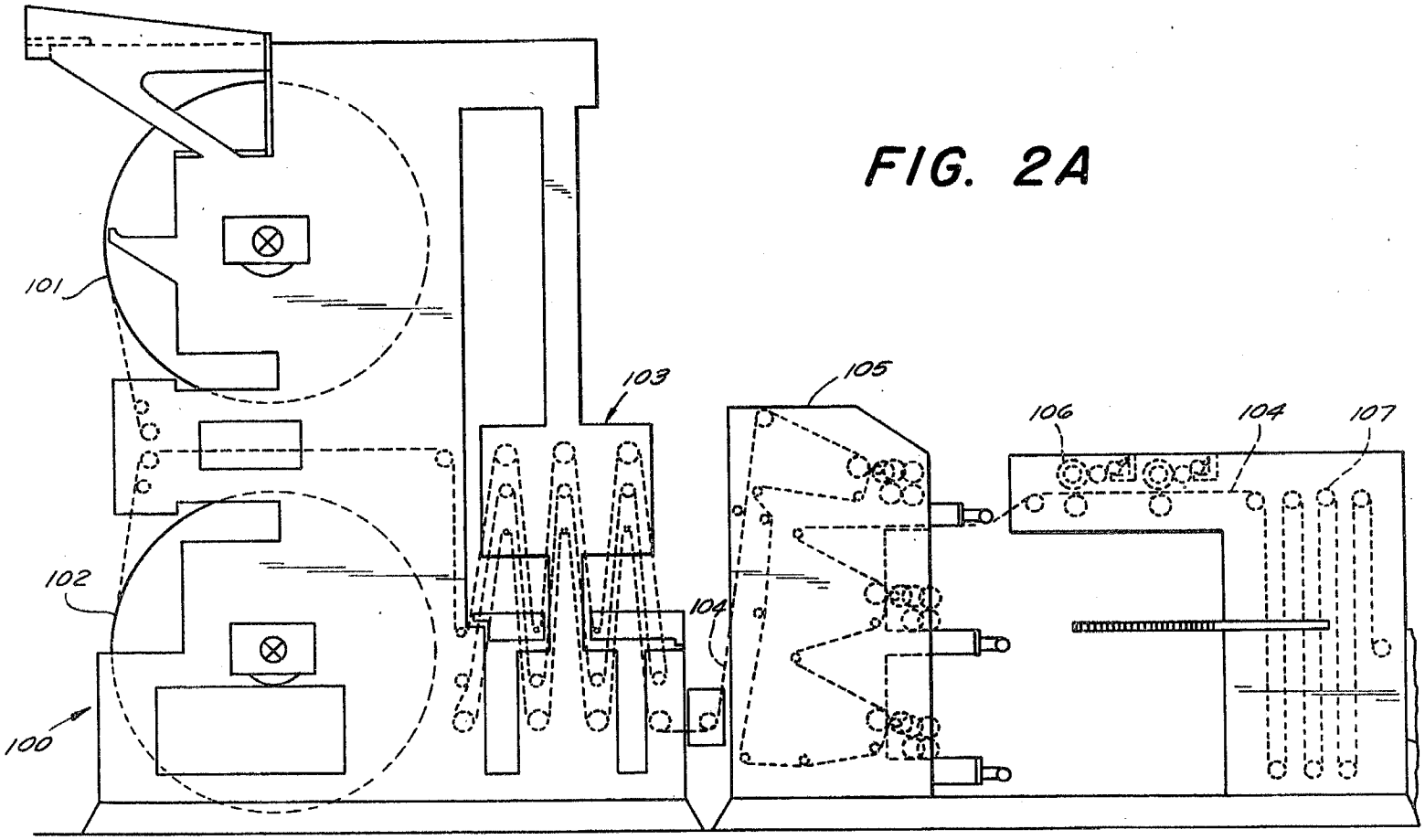
Figure 2B:
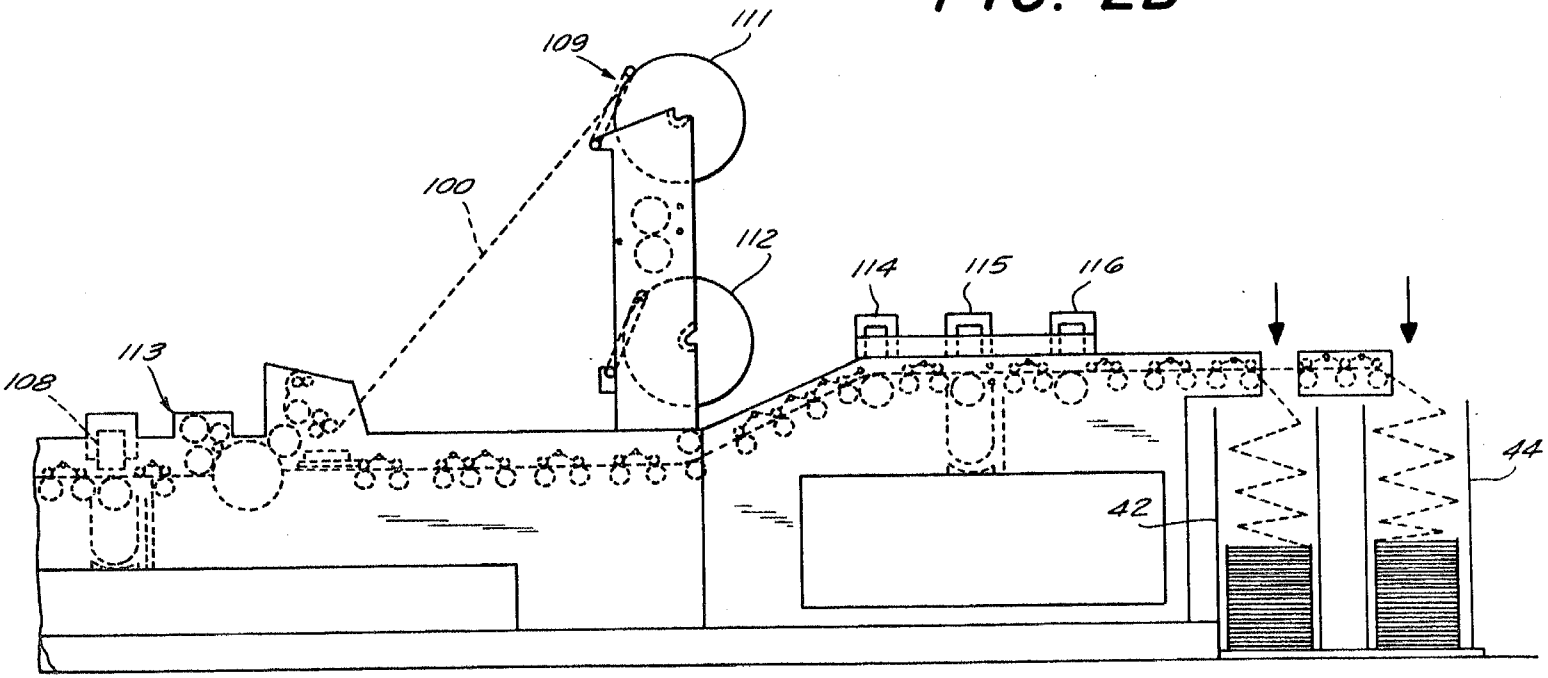
Figure 3:
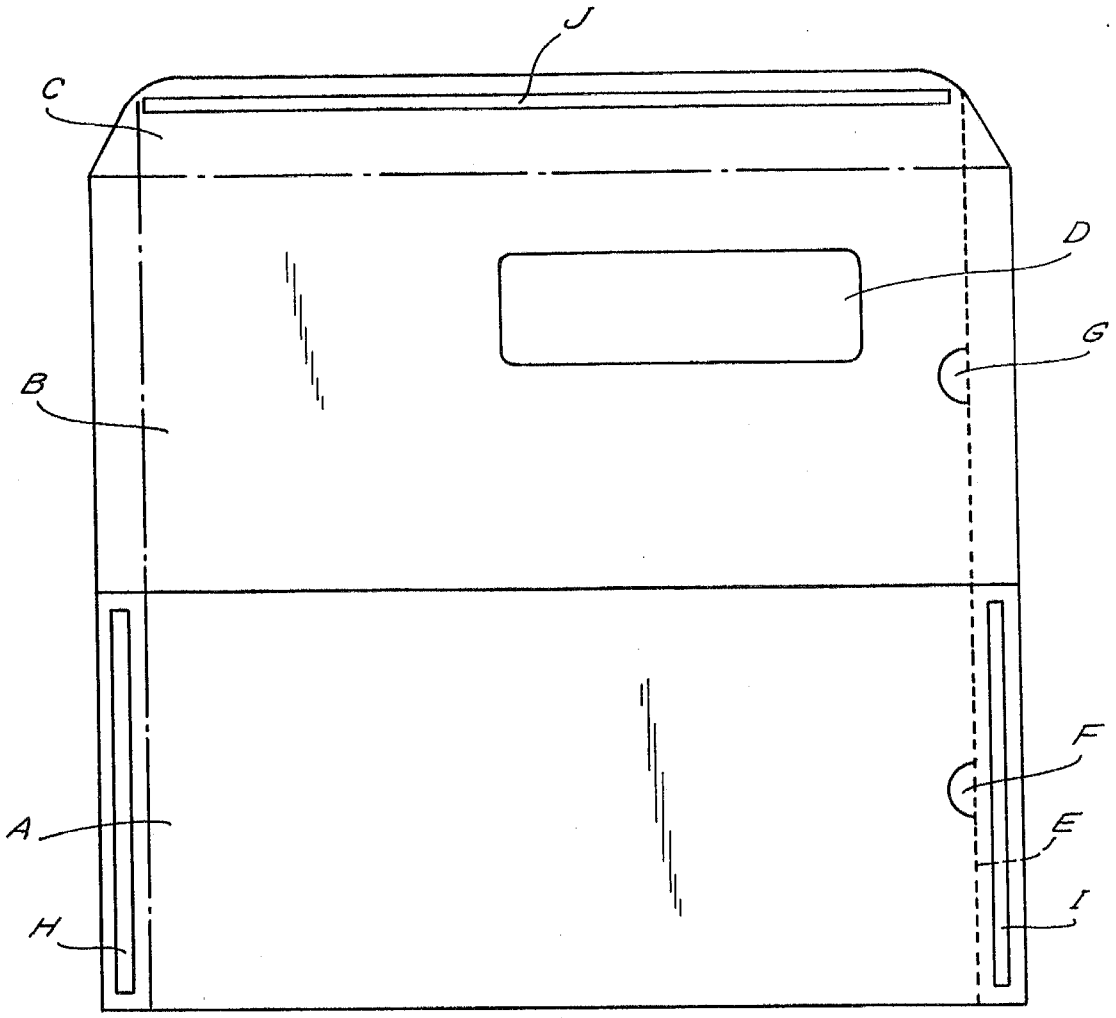
Figure 5:
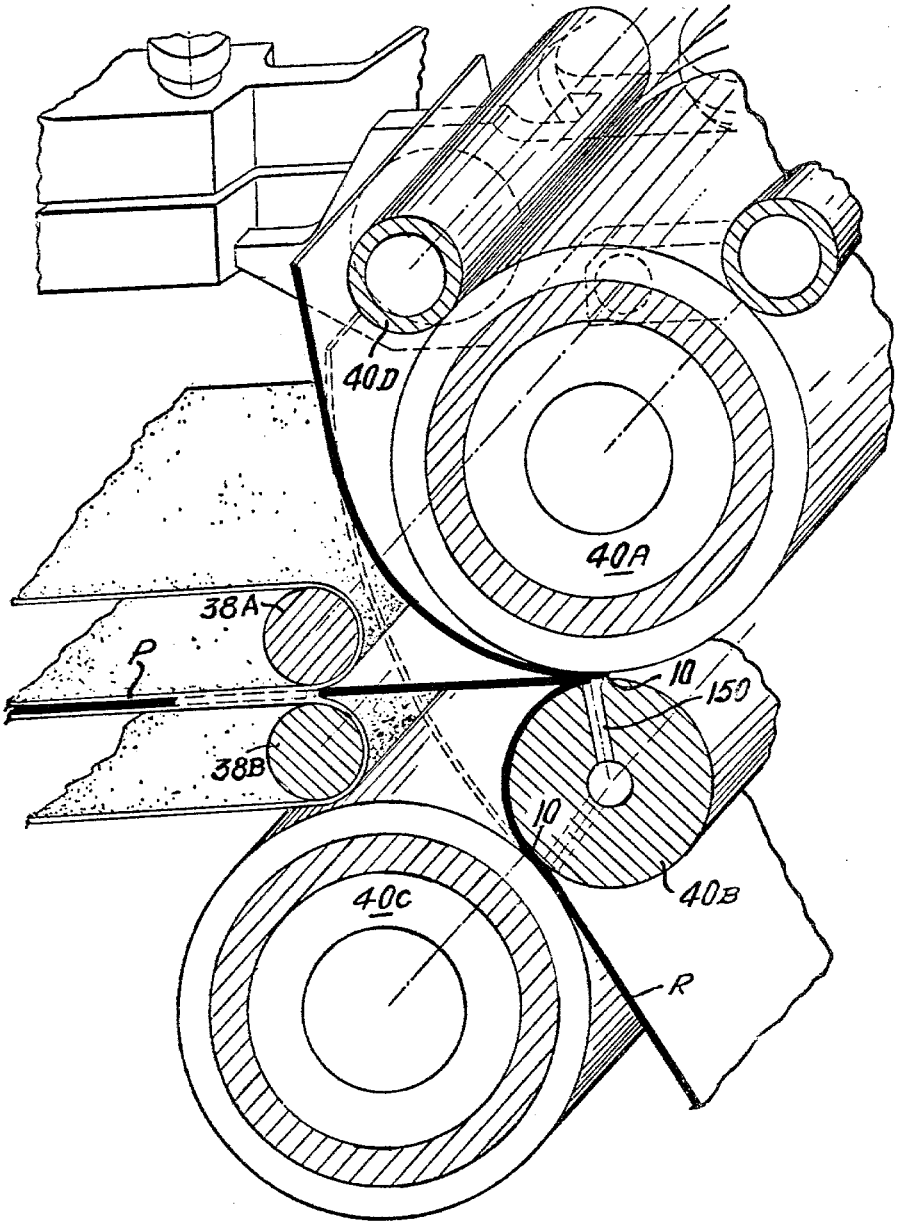

FIG. 1B shows a more detailed elevational view of the machine,

FIG. 2A shows a schematic side view of a modified machine for producing a continuous track of envelope material for use in the machine according to the invention, FIG. 2B shows a schematic side view of another modification of the machine, FIG. 3 shows a view of a blank for an envelope according to the present invention, FIG. 4 shows a view of another envelope blank according to the invention, and FIG. 5 shows a detailed view of the enveloping station.

An example of a method according to the present invention will be described in more detail in the following, in conjunction with the machine shown in the drawing figures and first as in FIGS. 1A and 1B for carrying out the method. The machine according to FIGS. 1A and 1B naturally only serves the purpose of carrying out one of the various method steps covered by the concept of the invention.

A printer 1 has a magazine 2 with a single or double continuous track or form sheets 3. A double track is used in cases when the maximum capacity of the printer needs to be utilized. The track can consist of an arbitrary quantity of copies, according to the number of copies required. The track is provided with transverse perforations for subsequent separation of the track into separate forms. (Dividing of a double track takes place by means of longitudinal cutting in a dividing and edge trimming unit 5).

Separation of carbon paper and removal of the copies from the track which are to be retained as own copies are carried out in a separator 4. Edge trimming and dividing of the track into separate items takes place in the dividing and edge trimming unit 5.

From the unit 5, the original and a predetermined number of copies placed on top of each other are fed as one item into the part of the machine in which the method is carried out, and which has been given the working designation "ROTASVEP".

As shown in FIG. 1B, the item to be enclosed is gripped by the pair of rollers 6 and 7 and is thereafter fed to a folding station 8. The folding station consists of five rollers 9, 10, 11, 12 and 13, and a folding pocket 14 (the folding pocket is of a conventional design, and will not be described in detail). By means of pairs of rollers 15, 16 and 17, the folded item is fed on into an insertion station 18. The insertion station consists of the rollers 19, 20, 21 and 22, and an insertion table 23 (the insertion station is also of a conventional design, and will not be described in detail). The insertion station is intended for use in cases when the item or items are to be supplemented with pre-printed matter. Varying numbers of insertion stations of this type can be applied, either parallel to each other or one after the other.

From the insertion station (or stations) the item or items are fed on with the aid of the pairs of rollers 24, 25, 26, 27, 28, 29, 30, 31, 32, 33, 34, 35, 36, 37 and 38 to an envelope station 39, which comprises a pair of rollers 40A and 40B in which roller 40B is a suction roller, and a heating unit 41.

Leading to the enveloping station 39 there is also a conveyor track from a magazine 42, in which blanks for envelopes are stored in a continuous strip or track 43, either zig-zag folded or in a roll. The envelope blanks can be separated from each other by means of a perforation to facilitate the separation. As will be noted from FIG. 1B, the envelope blank magazine 42 can be supplemented with another magazine 44 connected to another envelope blank track 45, which has its own feeding conveyor in the form of two pairs of feeding rollers 46 and 47, and a pair of indication rollers 48. The envelope blank track is fed into the conveyor to the enveloping station 39 with the aid of a pair of indication rollers 50 and pairs of transport rollers 51 and 52. From the pair of rollers 52 the envelope blank track is conveyed to a creasing station 53 of conventional design, which consists of a pair of rollers 54 for creasing each and every envelope blank in such a way that they are divided up into preferably three sections, A, B and C (FIG. 3).

Sections A and B are, in principle, of equal size, while section C is intended to form a sealing flap. According to FIG. 3, section B can be provided with a window D, which is preferably covered with a transparent material, e.g. pergamyn. According to FIG. 3 the envelope blank can also be provided with an opening perforation E, with punched out thumb recesses F and G, which facilitate the removal of the contents of the envelope after it has been opened. Along its side edges, section A is provided with heat-activated strips of glue H and I. Section C is also provided with a heat-activated strip of glue J along its long side. The envelope blank is fed towards the enveloping station 39 with section C facing the magazine 42.

From the creasing station 53 the envelope blank track is conveyed further with the aid of a pair of rollers 55 to a pair of rollers 56 for longitudinal dividing, which is used only in cases when a double envelope blank track is used. From the pair of rollers 56 the track is transported via a pair of rollers 57 to a pair of separating rollers 58, 59, in which one of the rollers, for instance roller 59 can be provided with a knife blade for separation when there is no perforation between the envelope blanks.

From the pair of separation rollers 58, 59 the individual envelope blanks are fed to the enveloping station 39, where they are placed in such a position that the crease between sections A and B will be drawn to the contact point between the pair of rollers 40A and 40B. During this time section A will be positioned in the heating device 41, whereby the strips of glue H and I (FIG. 3) will be activated and become adhesive.

FIG. 5 shows the manner in which the rollers 40A and 40B fold the envelope blank "R" about the crease between the sections A and B such that the crease is sucked into contact with the nip between the pair of rollers 40A and 40B. An envelope blank "R" is fed from the magazine 42 as described above, and fed to the nip between the rollers 40C and 40B. The roller 40C is rotatably mounted below the rollers 38A and 38B of the roller pair 38 and conveys the envelope blank "R" upwardly along with the roller 40B toward the heating device 41. (The roller 40C has not been shown in FIG. 1B for clarity). The roller 40B is so mounted such that its circumference forms a first nip with the circumference of the roller 40C and a second nip with the circumference of the roller 40A. The first nip is preferably spaced from the second nip between 90 and 180 degrees about the circumference of the roller 40B taken in a direction from the first nip toward the second nip. Roller 40B has a vacuum port 150 which connects a vacuum source (not shown) to the circumference of the roller so that a crease 10 separating the sections A and B will hold fast to the circumference of the roller 40B and thereby follow the path of movement of the circumference of the roller 40B. When an envelope blank "R" is fed to the roller 40C and 40B, it is conveyed upwardly so that section A is placed in the heating device 41. Further, the rotation of the roller 40B is controlled that the vacuum port 150 contacts the crease 10 for each advacement of an envelope blank. This initial positioning of the envelope blank "R" is shown in dashed lines in FIG. 5. Upon rotation of the rollers 40C and 40B the crease 10 follows the circumference of the roller 40B so that it is drawn into the second nip between the rollers 40A and 40B, as shown in solid line in FIG. 5, thereby folding the envelope blank about the crease 10. This folding is coincidental with the insertion of the enclosures "P" from the rollers 38A and 38B, as the second nip formed by the rollers 40A and 40B lies in the plane of the nip formed between the rollers 38A and 38B. As the rollers 40A and 40B advance the envelope blank "R" and thereby cause the section A to fold about section B, the heated strips H and I will hold the two sections together upon complete advancement of the envelope blank through the second nip. The vacuum port 150 may extend the whole width of the second roller 40B, or may otherwise be subdivided into a pair of branches which are positioned at either end of the roller 40B.

The item to be enclosed is fed by the pair of rollers 38A and 38B towards the envelope blank, which it contacts in the crease between sections A and B. The rollers 40A and 40B feed the envelope blank and the item to be enclosed further, whereby the sections A and B of the envelope blank are folded against each other and enclose the item. The strips of glue H and I, which are activated, adhere to the edges of section B. From the pair of rollers 40A and 40B, the envelope with enclosed matter is fed through the pairs of rollers 60, 61, 62, 63, 64, 65 and 66, to a further folding station 67 with the pairs of rollers 68 and 69 and a folding pocket 70 and a heating device 71. (This folding station is also of a conventional design, and will not be described in detail.) In the folding station 67 section C is folded over the opening between sections A and B, whereby the envelope is sealed after activation of the strip of glue J on section C in the heating device 71. From the pair of rollers 69 the now sealed item of mail is fed on between the pairs of rollers 72, 73 and 74 to a postage meter 75 with the pairs of rollers 76, 77 and 78. From the postage meter 75 the stamped and sealed items of mail are fed to a bunching device 79 for stacking the stamped and sealed items of mail on a table 80.

The machine or assemblage described (ROTASVEP) can also be arranged for processing of more than two parallel tracks of enclosures and envelope blanks running through the machine. The machine can also be used only for inserting enclosures fed from the insertion stations into envelopes, i.e. without being connected with a printer. The number of insertion stations can then be varied, and they can be placed one after the other or parallel to each other.

If no copies are required, the printer can apply the text directly on the inside of an envelope blank track, which track is fed into the printer from the magazine 2. In such a case each envelope blank must be provided with perforations along all four sides and strips of glue K, L and M along three sides, as shown in FIG. 4. The endless envelope blank track is provided with a transverse scoring or perforations between each envelope blank and with pin feed tracks on each side for transportation through the printer 1 directly to the dividing and edge trimming unit 5. Also with this embodiment the envelope blank track can consist of two or more envelope blanks beside each other.

Supplementary enclosures, if any, can be placed together with the envelope blank when it passes the insertion station 18. The folding station 8 and the heating device 41 are not utilized for this alternative. Activation of the strips of glue K, L and M takes place in the heating device 71, folding in the folding station 67, and sealing and stamping in the pairs of rollers 72–78.

FIGS. 2A and 2B show a schematic side view of a machine according to FIG. 1B for manufacturing envelope blanks for use in the machine according to FIG. 1B. The material used is arranged in the form of a roll magazine 100, which in this case comprises an upper roll 101 and a lower roll 102, as well as a tensioning and regulating device 103. (The magazine 100 is of a conventional design, and will not be described in detail.) From the magazine 100 a track 104 is fed into a printing unit 105 for printing on one or both sides of the track, before it is fed into a glue application unit 106 for application of the strips of glue H, I and J. After the glue application unit 106 the track is fed into a drying unit and from there to a punch 108 for punching out the window B. In a pergamyn station 109 a strip of pergamyn 110 is fed from an upper roll 111 or a lower roll 112 to an application device 113 for glueing the pergamyn over the window B which has been punched out by the punch 108. From the device 113 the track is fed on to a forming punch and a perforation roller 114, and from there to a cutting station 115 for longitudinal cutting of the track into several parallel tracks. The cutting station 115 is followed by a dividing station 116 for crosswise cutting of the track when its magazine 42 or 44 has been filled.

What is claimed is:

1. An apparatus for producing a folder in the form of an envelope with at least one enclosure, said envelope being made from an envelope blank having a first section, a second section, and a third section formed by a first crease and a second crease, respectively, comprising: first conveying means for conveying enclosures along a first rectilinear path; second conveying means for conveying envelope blanks along a second rectilinear path; said first and second paths intersecting at a common location; and an enveloping station located at said intersection of said first and second paths for folding said envelope blanks about said enclosures and about said first crease dividing said first and second sections, said first section having a first and a second strip of adhesive thereon, said enveloping station comprising a first rotating roller mounted below said first path, and a second rotating roller, said first and second rotating rollers being rotatably mounted in said enveloping station so as to receive therebetween said envelope blanks from said second conveying means, said first and second rotating rollers defining therebetween a first nip below the end portion of said first path for advancing said envelope blanks upwardly toward said end portion, said second roller having vacuum means for holding said first crease of each envelope blank fast thereto, and a third rotating roller rotatably mounted above said second rotating roller at a point on the circumference of said second rotating roller remote from said first nip so as to define a second nip spaced circumferentially about said second roller from said first nip, said second nip lying in a plane containing said end portion of said first path, said first nip and second nip being spaced about the circumference of said second roller by more than 90 degrees but less than 180 degress in the direction of rotation of said second roller, said enveloping station further comprising a heating device for heating said first section when said first crease is held fast by said vacuum means, so that said first and second adhesive strips formed on said first section become activated and thereby glue the first and second sections together upon advancement of said envelope blank through said second nip, said heating device being mounted above said third roller, whereby prior to the folding and sealing of said first and second sections at least one enclosure is advanced to said second nip and thereby enclosed in said envelope blank between said first and second sections.

2. The apparatus according to claim 1, wherein said vacuum means comprises a vacuum port and a source of vacuum, said vacuum port connecting said source of vacuum with a portion of the circumference of said second roller, so that said envelope blank is held to said circumference of said second roller at said portion.

3. The apparatus according to claim 1, further comprising third conveying means for conveying said folded envelope blank with said at least one enclosure therein along a third path, and a folding station at the end of said third conveying means for folding said third section about said second section at said second crease to thereby form a completed and sealed envelope with at least one enclosure.

4. The apparatus according to claim 1, wherein the rotation of said second rotating roller is controlled so that said vacuum means is positioned adjacent to a new first crease of a new envelope blank upon each rotation thereof, whereby a continuous formation of envelopes with at least one enclosure is achieved.

5. The apparatus according to claim 4, wherein said vacuum means comprises a vacuum port and a source of vacuum, said vacuum port connecting said source of vacuum with a portion of the circumference of said second rotating roller, so that said envelope blank is held to said circumference of said rotating second roller at said portion, said vacuum port extending the entire width of said rotating second roller so that said first crease is held fast to said portion of said circumference along the entire width of said rotating second roller.

* * * * *